US008966700B1

(12) United States Patent
Morad et al.

(10) Patent No.: US 8,966,700 B1
(45) Date of Patent: Mar. 3, 2015

(54) SIMPLIFIED APPARATUS TO REMOVE A DISPOSABLE SPONGE FROM A HAND OPERATED SQUEEZE SPONGE MOP WITHOUT HAVING TO TOUCH THE SPONGE

(71) Applicants: Fred I. Morad, Toluca Lake, CA (US); William P. Camp, Jr., Vanlue, OH (US)

(72) Inventors: Fred I. Morad, Toluca Lake, CA (US); William P. Camp, Jr., Vanlue, OH (US)

(73) Assignee: Worldwide Integrated Resources, Inc., Montebello, CA (US)

( * ) Notice: Subject to any disclaimer, the term of this patent is extended or adjusted under 35 U.S.C. 154(b) by 0 days.

(21) Appl. No.: 14/229,893

(22) Filed: Mar. 29, 2014

(51) Int. Cl.
*A47L 13/146* (2006.01)
*A47L 13/257* (2006.01)
*A47L 13/46* (2006.01)

(52) U.S. Cl.
CPC ..... *A47L 13/257* (2013.01)
USPC ..... 15/116.2; 15/118; 15/119.2; 15/244.1; 15/115

(58) Field of Classification Search
USPC ..... 15/115, 116.2, 118, 119.2, 244.1
See application file for complete search history.

(56) References Cited

U.S. PATENT DOCUMENTS

| | | | | | |
|---|---|---|---|---|---|
| 2,715,744 | A | * | 8/1955 | Ljungdahl | 15/119.2 |
| 2,717,406 | A | * | 9/1955 | Herman et al. | 15/244.1 |
| 4,468,830 | A | * | 9/1984 | Batchelor | 15/119.2 |
| 4,468,832 | A | * | 9/1984 | Batchelor | 15/244.1 |
| 4,509,224 | A | * | 4/1985 | Batchelor | 15/244.1 |
| 5,406,667 | A | * | 4/1995 | Teufel et al. | 15/119.2 |
| 7,257,853 | B2 | * | 8/2007 | Boyer et al. | 15/119.2 |

FOREIGN PATENT DOCUMENTS

| | | | |
|---|---|---|---|
| EP | 494021 | * | 7/1992 |
| GB | 2238232 | * | 5/1991 |

* cited by examiner

*Primary Examiner* — Mark Spisich
(74) *Attorney, Agent, or Firm* — Thomas I. Rozsa

(57) ABSTRACT

A hand operated squeeze sponge mop with a disposable sponge assembly where the sponge has a pair of spaced apart posts. Each post has a multiplicity of vertically ascending transverse notches on opposite sides of each post. A pair of spaced apart retention members is located on the main body, each retention member respectively having an aligned opening to receive a respective post and a pair of teeth to be received in a respective transverse notch of a post. Each tooth is formed as part of a tooth section having a transverse tooth and an upper squeeze handle. Each tooth section further includes an exterior flared section which functions as a spring. The spring force of the flared sections of a respective member forces a respective tooth into engagement with a transverse notch on a post.

12 Claims, 12 Drawing Sheets

SIMPLIFIED APPARATUS TO REMOVE A DISPOSABLE SPONGE FROM A HAND OPERATED SQUEEZE SPONGE MOP WITHOUT HAVING TO TOUCH THE SPONGE

BACKGROUND OF THE INVENTION

1. Field of the Invention

The present invention relates to the field of hand operated sponge squeeze mops which removably retain a sponge.

2. Description of the Prior Art

In general, various types of hand operated regular sponge mops or squeeze sponge mops are known in the prior art.

The hand operated regular sponge mop or squeeze sponge mop includes a generally rectangular-shaped main body having an upper or top surface which includes a handle receiving section which receives an elongated handle which is grasped by a user when operating the sponge mop and to which a sponge is retained on an underside of the main body. A rotatable squeeze section is hingeably attached to the main body and is pressed against the sponge to wring the sponged dry after it has been dipped in water with cleaning solution and used to clean or scrub a surface such as a dirty floor.

As described above, the main body also has a flat lower or bottom surface with a disposable cleaning sponge retained by a pair of spaced apart plastic bases molded into a top surface of the sponge, each plastic base retaining a threaded shaft which threaded shafts respectively extend through respective aligned openings in the main body and then each respective shaft is retained by respective mating fasteners such as a nut with a mating threaded interior opening by which the sponge is retained onto the main body.

One common problem with all prior art hand operated regular sponge mops and squeeze sponge mops is that when the sponge is very dirty after cleaning operations, the user must use at least one of his/her hands to grasp the dirty sponge after the retaining nuts are removed from their respective threaded shafts and remove the sponge from the regular sponge mop or squeeze sponge mop. Therefore, the user is exposed to the filth and dirt on the disposable sponge. There is a significant need for an improved apparatus which eliminates the requirement for a user to grasp the dirty sponge by hand when removing it from the regular sponge mop or squeezes sponge mop and replacing it.

SUMMARY OF THE INVENTION

The present invention is a hand operated squeeze sponge mop with a unique disposable sponge assembly where the sponge has a pair of spaced apart posts molded onto an upper surface of a plate which also has a lower surface molded onto an upper surface of the sponge. Each post has a multiplicity of vertically ascending transverse notches on opposite sides of each post. The main body of the hand operated squeeze sponge mop has a pair of spaced apart retention members each respectively having an aligned opening to receive a respective post and a pair of teeth to be received in a respective transverse notch of a post, each tooth formed as part of a tooth section having a transverse tooth and an upper squeeze handle. Each tooth section further includes an exterior flared section which functions as a spring. The spring force of the flared sections of a respective member forces a respective tooth into engagement with a transverse notch on a post. A squeeze force applied by squeezing two oppositely disposed squeeze handle sections together overcomes the spring force and disengages a respective tooth from a respective notch in a pos., thereby releasing the sponge.

It is an object of the present invention to provide a mechanism on a hand operated sponge mop including a standard sponge mop and a squeeze sponge mop which retains a sponge in a manner which enables the sponge after it has been used and becomes dirty to be released and fall into a trash receptacle without a user's hand touching the dirty cleaning sponge.

It is also an object of the present invention to provide a mechanism for a hand operated sponge mop which includes a retaining mechanism which includes flexible members to provide a closing spring force for teeth to engage a ratchet opening on a post of a sponge without requiring one or more actual springs. The retaining and release mechanism is more efficient and easier to use over prior art mop retaining mechanisms, including those created by the present inventors. A simple squeezing force enables the retention and release mechanism to release the posts by which the sponge is retained by a single squeezing force on each retention mechanism to release the teeth from the posts to quickly and efficiently release the sponge to enable the dirty sponge to be separated from the retaining members which retain the cleaning sponge onto the main body of the sponge mop so that the connection is released, enabling the sponge to be released without requiring a human hand to touch a dirty sponge.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated:

FIG. 8A-1 is a an exploded top perspective view of the first retention mechanism housing and the first retention member before it is inserted into the first retention mechanism housing;

FIG. 8A-2 is a bottom perspective view of the first retention mechanism housing;

FIG. 8B-1 is an exploded top perspective view of the second retention mechanism housing and the second retention member before it is inserted into the second retention mechanism housing;

FIG. 8B-2 is a bottom perspective view of the second retention mechanism housing.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
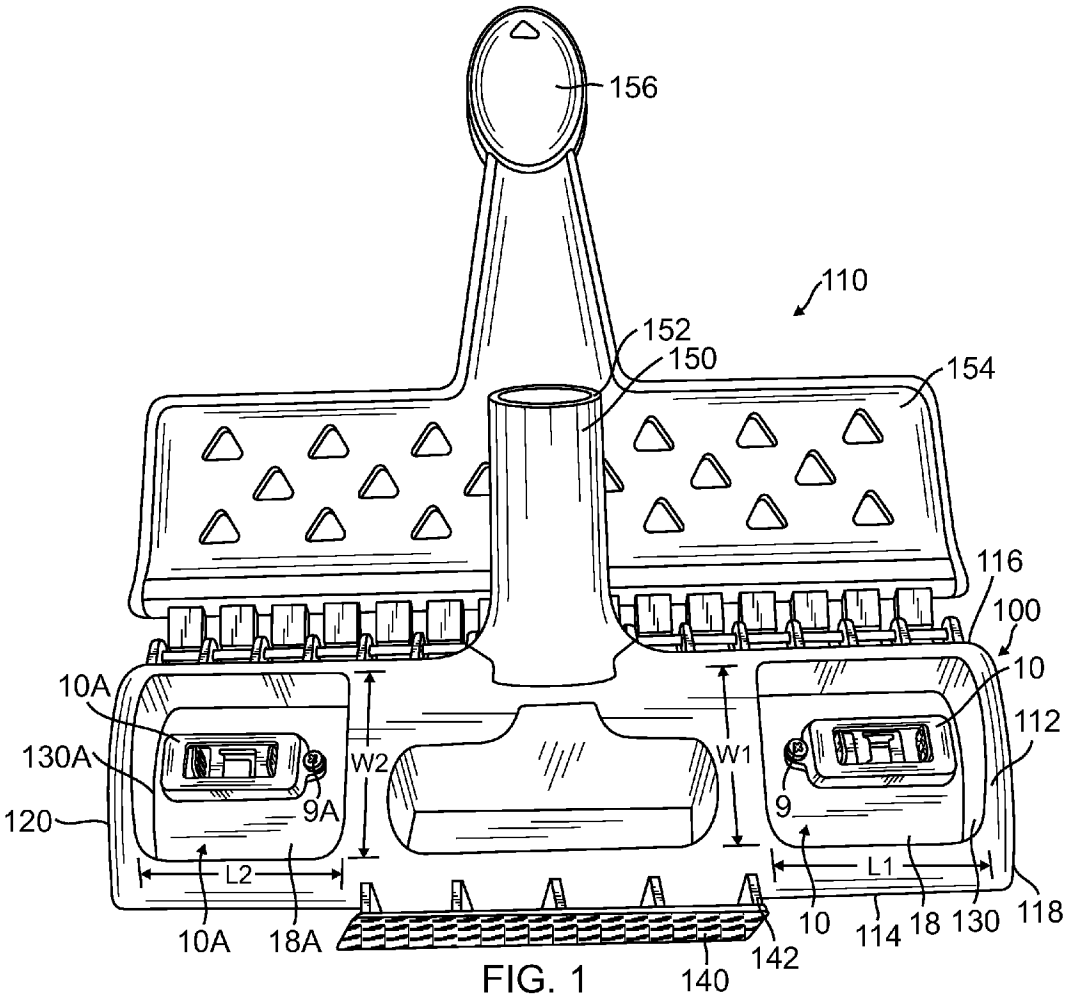
FIG. 1 is a top plan view of the present invention main body of a hand operated squeeze sponge mop illustrating the retainer for a hand retaining assembly which retains a collar into which an elongated handle is retained, and a pair of housings for retaining the operational mechanisms of the present invention including a top perspective view of each trigger mechanism respectively retained on the top of a housing, also illustrating the hingeably attached squeeze member.
Figure 2:
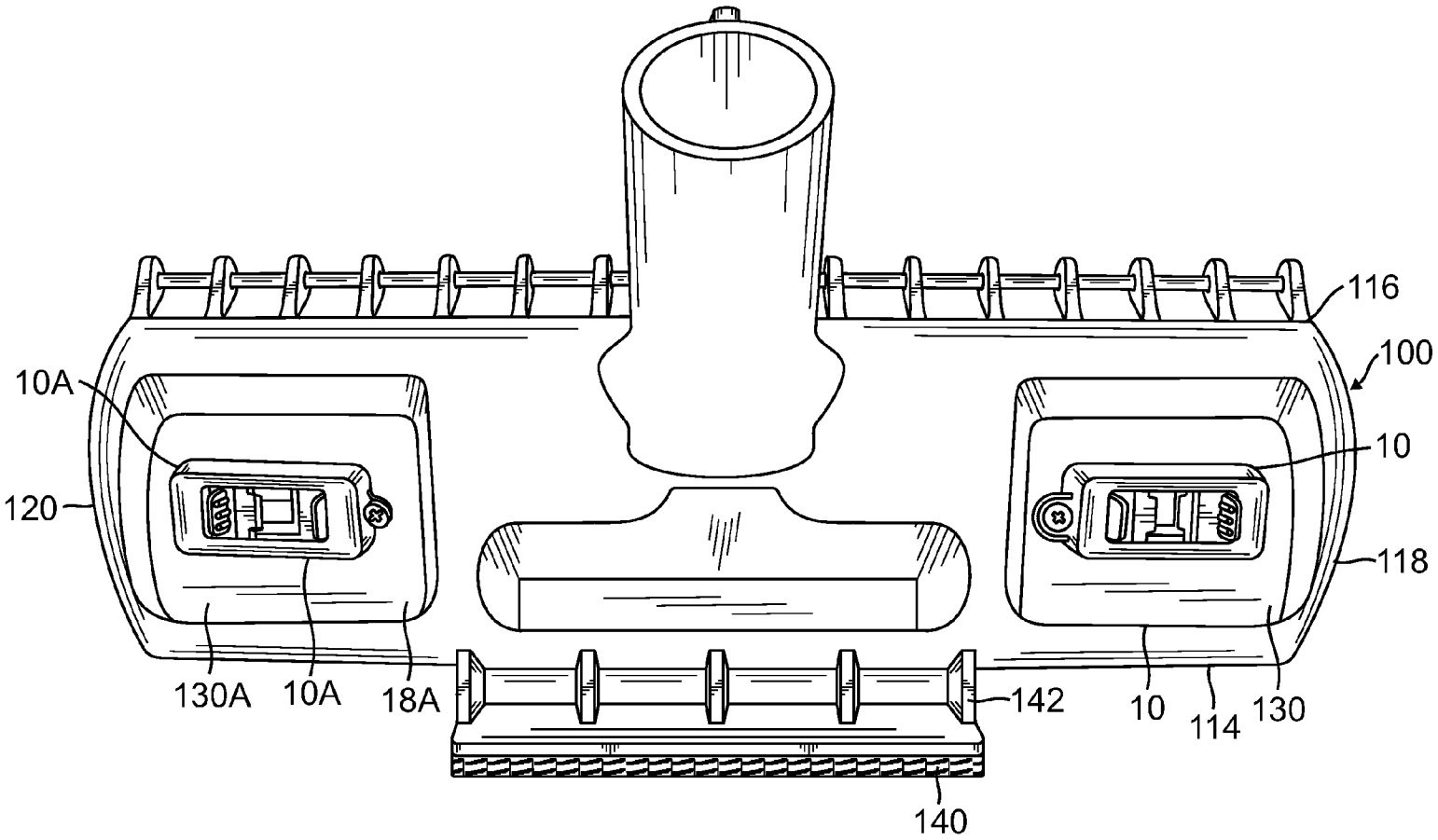
FIG. 2 is a partial top perspective view of the present invention main body of a hand operated squeeze sponge mop illustrating the retainer for a hand retaining assembly which retains a collar into which an elongated handle is retained, and a pair of housings for retaining the operational mechanisms of the present invention including a top perspective view of each trigger mechanism respectively retained on the top of a housing, without the hingeably attached squeeze member.

Referring to FIG. 1 and FIG. 2, there is respectively illustrated a top plan view of the present invention and a partial top perspective view of the present invention incorporated into a portion of the main body 100 of a hand operated squeeze sponge mop 110 illustrating a pair of housings 10 and 10A which respectively retain the operating mechanism of the present invention. The main body 100 has a top surface 112 with a first lengthwise side 114, a parallel spaced apart second lengthwise side 116, a first transverse side 118 and a second transverse side 120. The top surface 112 of the main body 100 has a first well 130 which has a length "L1" and a width "W1" which is large enough to permit two fingers of a person's hand to be inserted into the first well 130 to reach housing 10. Similarly, the top surface 112 has a second well 132 which has a length "L2" and a width W2" which is large enough to permit two fingers of a person's hand to be inserted into the second well 130A to reach housing 10A. Well 130 has a top surface 18 and well 130A has a top surface 18A. Also illustrated is a scrubbing brush 140 held by a brush retainer 142 affixed to the first lengthwise side 118 and partially onto top surface 112 of the main body 100. Illustrated in FIG. 1 is a handle retaining member 150 affixed to the main body 100, the handle retaining member including a collar 152 into which an elongated handle (not shown) is retained. Also illustrated is a squeeze member 154 having a handle 156.

Figure 3:
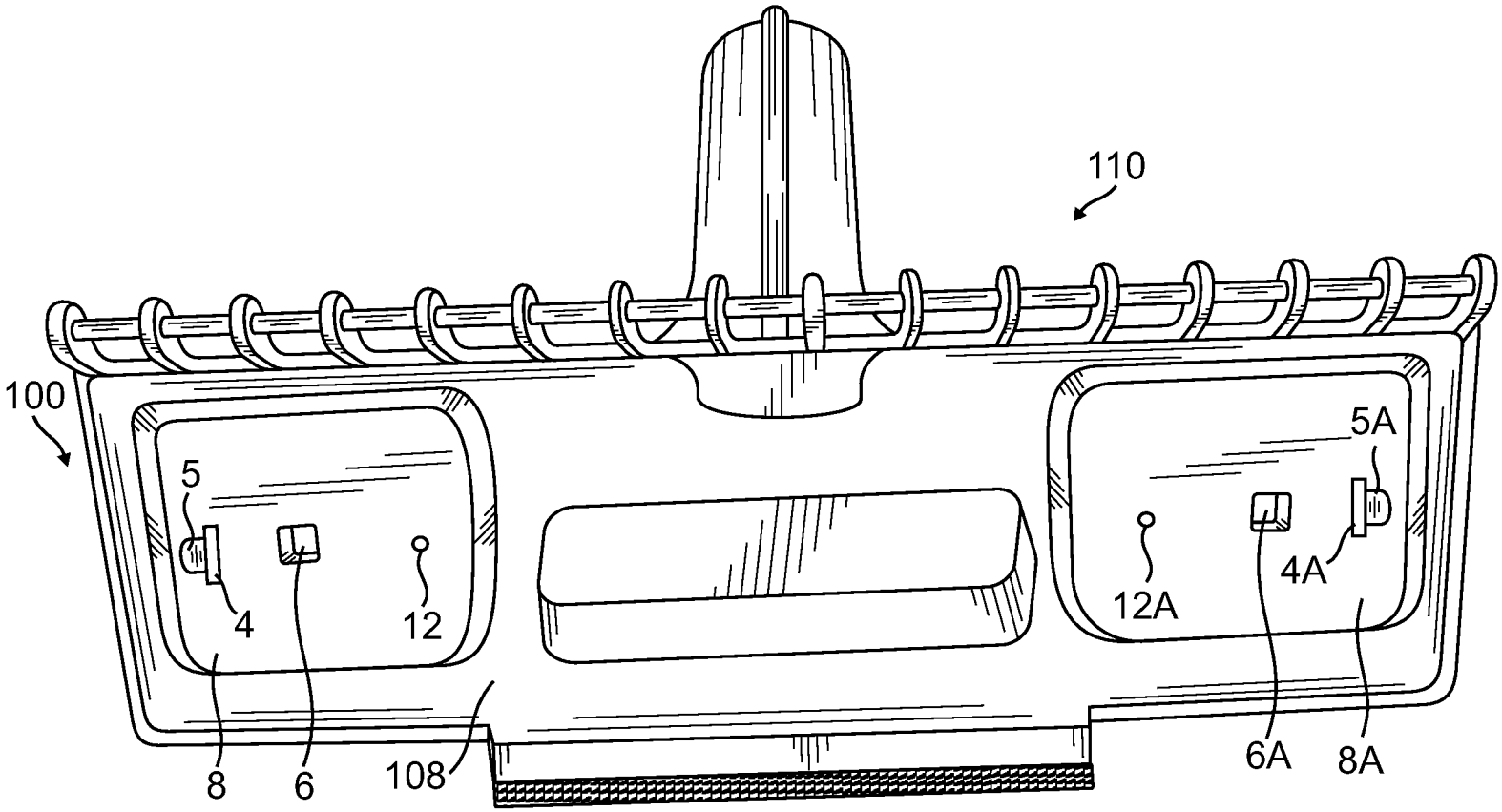
FIG. 3 is a bottom plan view of the bottom surface of the main body of the sponge mop, illustrating the respective openings in a respective retention mechanism housing to receive a respective post with transverse notches from the top surface of a molded plate which has its bottom surface molded to the top surface of a sponge.

FIG. 3 is a bottom plan view (rotated 180 degrees from the view in FIGS. 1 and 2) of the bottom surface 108 of the main body 100 of the sponge mop 110, illustrating the respective openings 12 and 12A in main body 100 at the center location of a respective retention mechanism housing to receive a respective post with transverse notches from respective posts on the top surface of a molded plate which has its bottom surface molded to the top surface of a sponge.

Figure 4A:
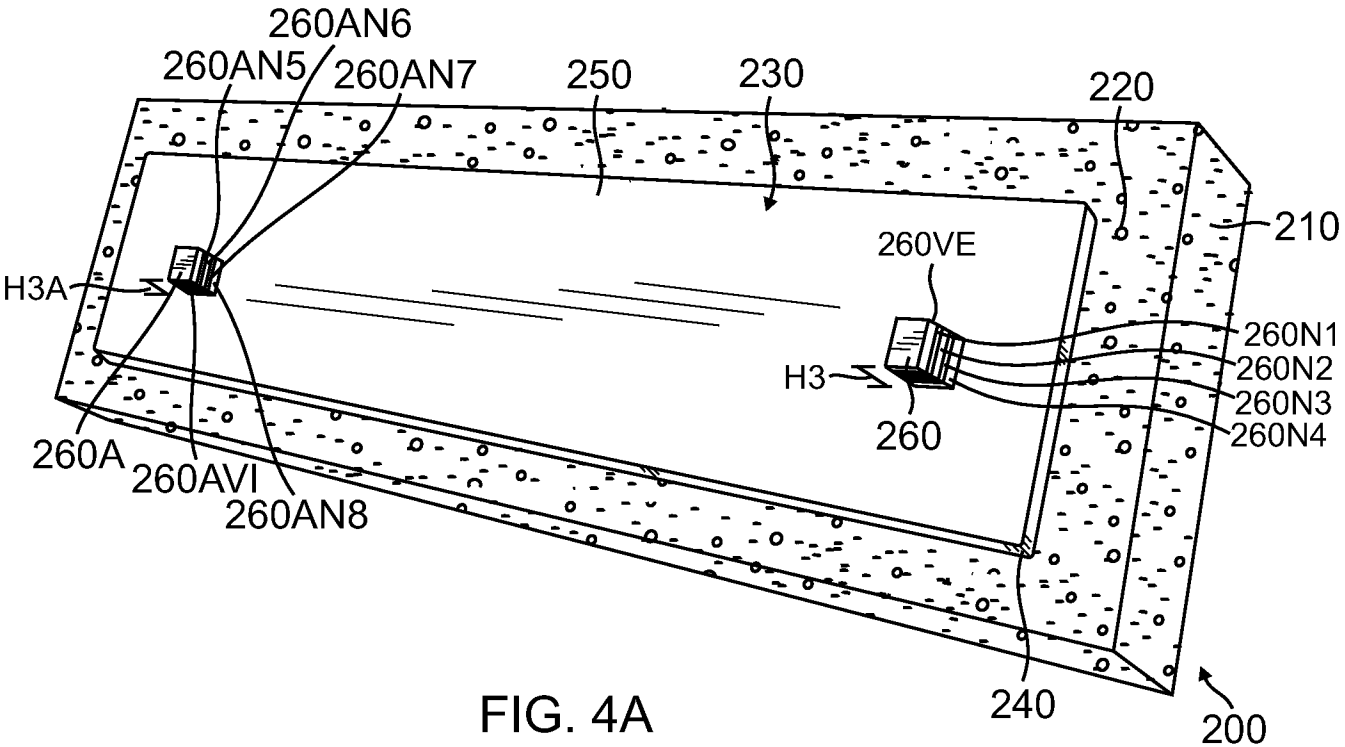
FIG. 4A is a top perspective view taken from a right side of a sponge with a plastic plate molded onto the top surface of the sponge, the plastic plate having a pair of spaced apart posts molded onto the top surface of the plastic plate, each post having a multiplicity of transverse notches or tooth receiving members.
Figure 4B:
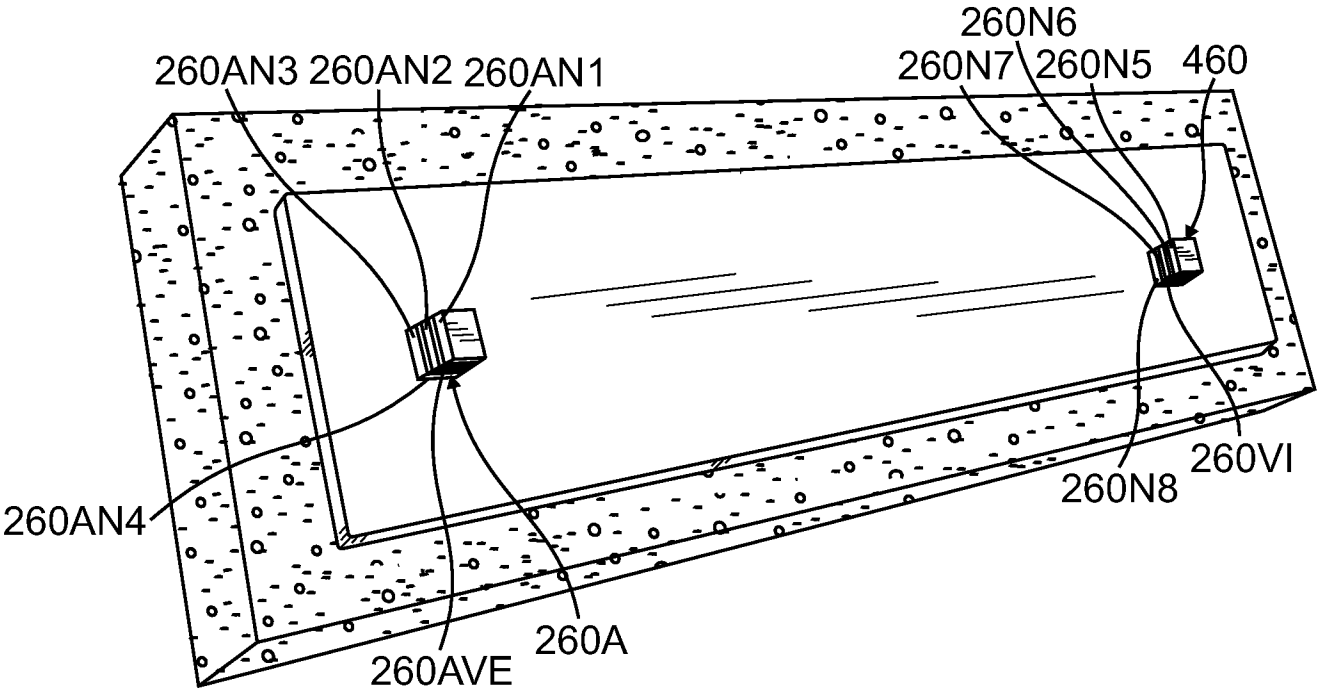
FIG. 4B is a top perspective view taken from a left side of a sponge with a plastic plate molded onto the top surface of the sponge, the plastic plate having a pair of spaced apart posts molded onto the top surface of the plastic plate, each post having a multiplicity of transverse notches or tooth receiving members.
Figure 9:
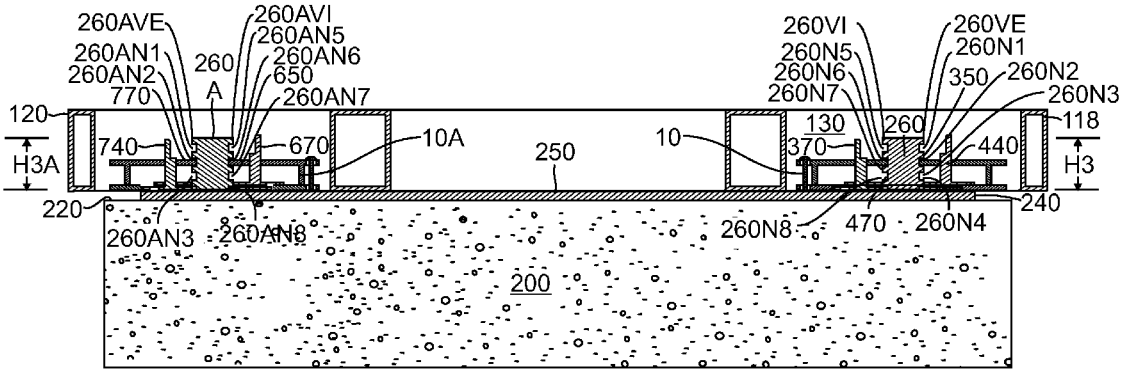
FIG. 9 is a cross-sectional view taken along line 9-9 of FIG. 6.

FIG. 4A is a top perspective view taken from the right side of a sponge 200 having a body 210 with at least a top surface 220. A plate 230 which can be made of moldable material such as plastic which is molded on its bottom surface 240 to the top surface 220 of sponge 200. The plate has integrally molded to its top surface 250 a pair of spaced apart posts, first post 260 and second post 260A, each post having a multiplicity of transverse notches or tooth receiving members along the height "H3" and "H3A" of a respective post 260 and 260A. FIG. 9 provides an additional more clear view of the notches on the posts. First post 260 has a multiplicity of outwardly extending notches 260N1, 260N2, 260N3 and 260N4 on its exterior vertical surface 260VE. Second post 260A also has a multiplicity of inwardly extending notches 260AN5, 260AN6, 260AN7 and 260AN8 on its interior vertical surface 260AVI. FIG. 4B is a top perspective view taken from the left side to correspond to the view of FIG. 4A, to illustrate notches on the opposite side of each respective post.

Referring to FIG. 4B and FIG. 9, first post 260 also has a multiplicity of inwardly extending notches 260N5, 260N6, 260N7 and 260N8 on its interior vertical surface 260V1. Similarly, second post 260A has a multiplicity of outwardly extending notches 260AN1, 260AN2, 260AN3 and 260AN4 on its exterior vertical surface 260AVE.

Figure 5:
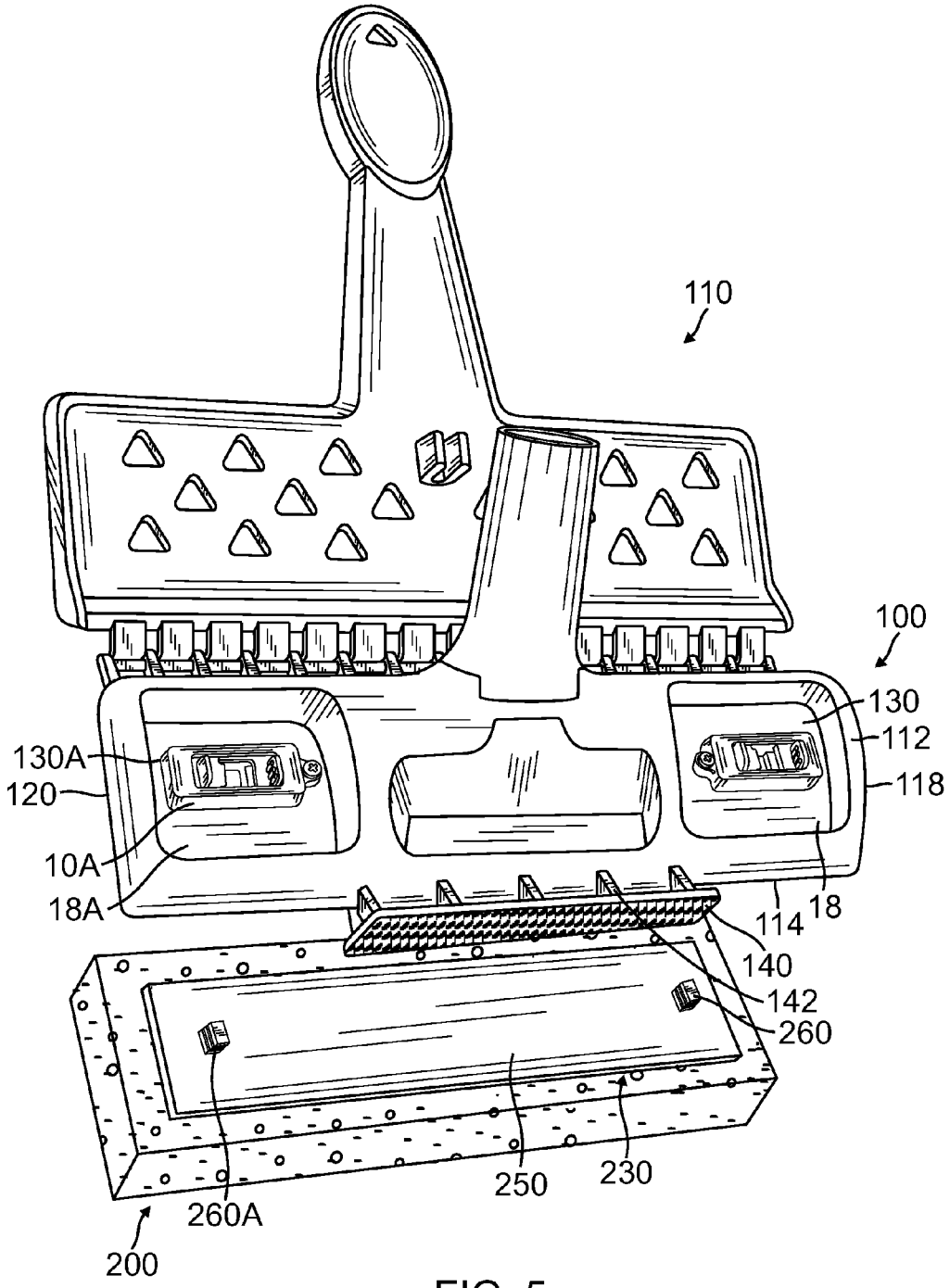
FIG. 5 is an exploded view including a top perspective view of the present invention main body of a hand operated squeeze sponge mop illustrating the retainer for a hand retaining assembly which retains a collar into which an elongated handle is retained, a scrub brush is retained, and a pair of housings for retaining the operational mechanisms of the present invention including a top perspective view of each of a pair of posts with notches to respectively receive an oppositely disposed tooth from respective tooth retaining members including a horizontal tooth section and a vertical squeeze member section, a pair of tooth sections facing each other with a gap between them into which a post from the top of the sponge is inserted and retained on either side by a respective tooth inserted into a notch, the figure also illustrated a top perspective view of a sponge with a molded horizontal plate on its top surface, the molded horizontal plate having a pair of spaced apart posts with transverse notches on each post.

FIG. 5 is an exploded view including a top perspective view of the present invention main body 100 of a hand operated squeeze sponge mop 110 illustrating the pair of retaining members for a retaining assembly which retains a respective retaining post 260 and 260A in a retaining mechanism having a pair of housings for retaining the operational mechanisms of the present invention including a top perspective view of each of a pair of tooth retaining members including a horizontal tooth section and a vertical squeeze member section, a pair of tooth sections facing each other with a gap between them into which a post from the top of the sponge is inserted and retained on either side by a respective tooth inserted into a respective notch on.

Figure 6:
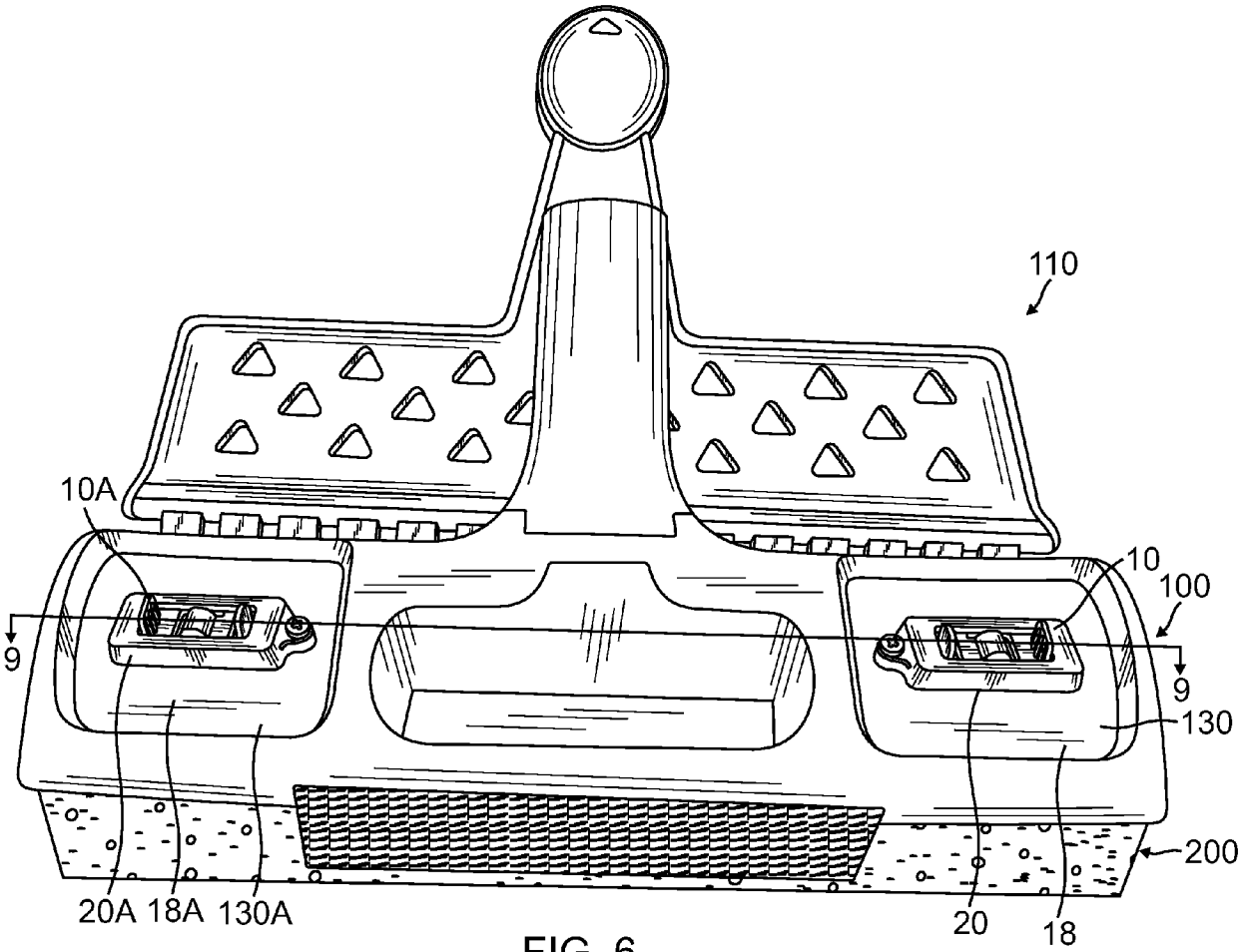
FIG. 6 is a front perspective view of the assembled present invention taken from the exploded view of FIG. 5, including a main body of a hand operated squeeze sponge mop illustrating a mop retained under the bottom surface of the main body by the present sponge retention assemblies.

FIG. 6 is a front perspective view of the assembled present invention with the part numbers already described in FIG. 5.

Figure 7A:
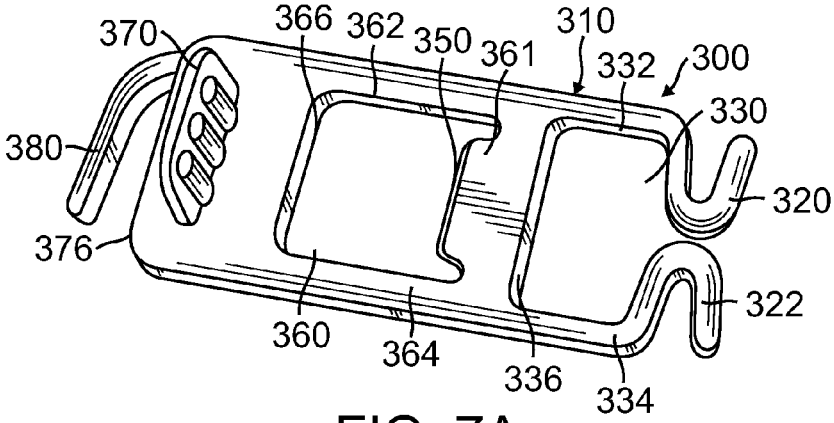
FIG. 7A is a top perspective view of a first section of a first retention mechanism including a body having a pair of flared oppositely extending members at one end and forming an end wall of a first end opening within the body, the first end opening surrounded by a pair of oppositely disposed sidewalls and an end wall, a horizontal tooth formed in the body facing a central opening which is surrounded by a tooth retaining wall at one end and a pair of sidewalls and an end wall of the body, and a squeeze handle portion extending perpendicular to the body and adjacent an opposite end of the body and a flared member extending from the opposite end wall of the body.

FIG. 7A is a top perspective view of a first section of a first retention mechanism 300 including a body 310 having a pair of oppositely disposed extending flared members 320 and 322 at one end and forming an end wall of a first end opening 330 within the body, the first end opening surrounded by a pair of oppositely disposed sidewalls 332 and 334 and an end wall 336 which extends to a horizontal tooth 350 formed in the body facing a central opening 360 which is surrounded by a tooth retaining wall 361 at one end and a pair of sidewalls 362 and 364 and an end wall 366 of the body, and a second squeeze handle portion 370 extending perpendicular to the body 310 and adjacent an opposite end of the body 310 and a flared member 380 extending from the opposite end wall 376 of the body 310.

Figure 7B:
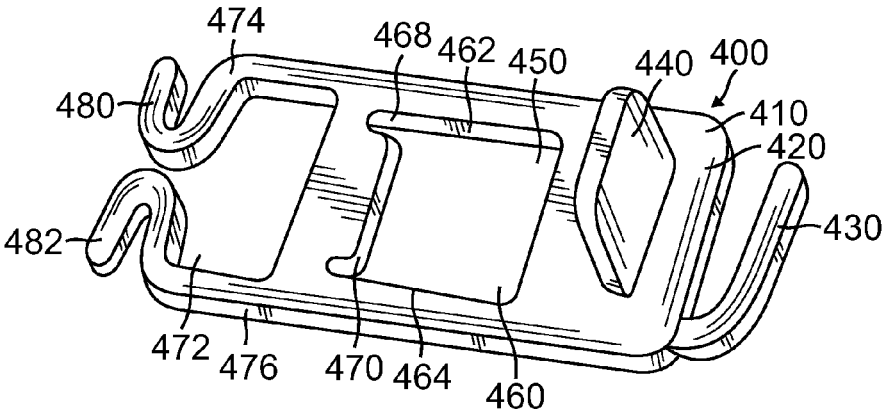
FIG. 7B is a top perspective view of a second section of a first retention mechanism including a body having a first end wall and a flared member extending from the end wall, a squeeze handle portion extending perpendicular to the body and spaced apart from the first end wall, a central opening within the body and surrounded by an end wall, a pair of parallel sidewalls and another end wall having a second tooth extending into the opening, the oppositely extending wall retaining the tooth extending to a second end opening surrounded by the sidewalls, a pair of sidewalls, and a pair of oppositely extending flair members also forming an end wall of the second end opening.

FIG. 7B is a top perspective view of a second section 400 of a first retention mechanism including a body 410 having a first end wall 420 and a flared member 430 extending from the end wall 420, a first squeeze handle portion 440 extending perpendicular to the body 410 and spaced apart from the first end wall 420, a central opening 450 within the body 410 and surrounded by an end wall 460, a pair of parallel sidewalls 462 and 464 and another end wall 468 having a second tooth 470 extending into the opening 450, the oppositely extending wall 468 retaining the tooth 470 extending to the opening, the oppositely extending wall 468 retaining the tooth 470 extending to a second end opening 472 surrounded by the extending wall 468, a pair of sidewalls 474, 476, and a pair of oppositely extending flair members 480 and 482 also forming an end wall of the second end opening 472.

Figure 7C:
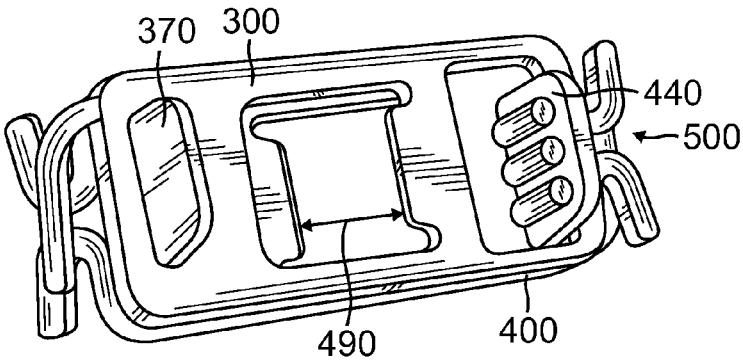
FIG. 7C is a top perspective view of the assembled first retention mechanism with the first section on top of the second section so that second squeeze handle portion of the first section extends sitting on top of the first end opening of the second section and the first squeeze handle portion of the second section extends through the first end opening of the first section, the middle openings are aligned so that the tooth from the first section and the tooth from the second section face into the aligned middle openings and towards each other with a gap between each tooth, the tooth from the first section is at a location elevated higher than the location of the tooth of the second section, the pair of flared oppositely extending members of the first section resting on and above the flared member of the second section and the flared member of the first section resting on and above the pair of flared oppositely extending members of the second section.

FIG. 7C is a top perspective view of the assembled first retention mechanism 500 with the first section 300 on top of the second section 400 so that second squeeze handle portion 370 of the first section 300 extends sitting on top of the first end opening 472 of the second section 400 and the first squeeze handle portion 440 of the second section 400 extends through the first end opening 330 of the first section 300, the middle openings 360 and 450 are aligned so that the tooth 350 from the first section 300 and the tooth 470 from the second section 400 face into the aligned middle openings 360 and 450 and towards each other with a gap 490 between tooth 350 and tooth 470, the tooth 350 from the first section 300 is at a location elevated higher than the location of the tooth 470 of the second section 400, the pair of flared oppositely extending members 320 and 322 of the first section 300 resting on and above the flared member 430 of the second section 400 and the flared member 380 of the first section 300 resting on and above the pair of flared oppositely extending members 480 and 482 of the second section 400.

Figure 7D:
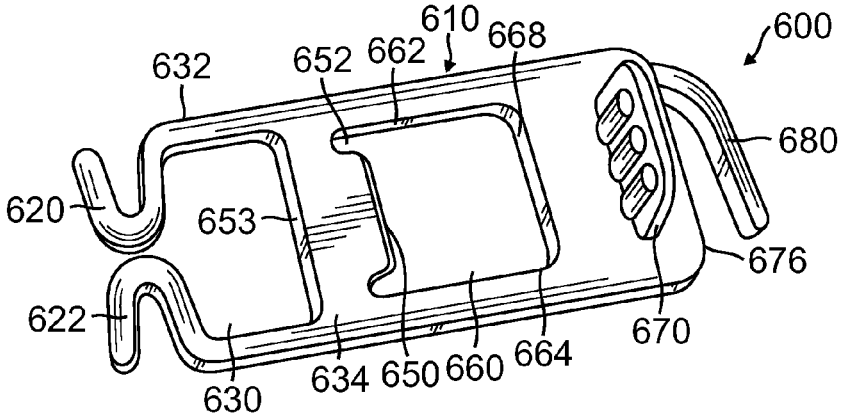
FIG. 7D is a top perspective view of a first section of a second retention mechanism 8 including a body having a first end wall and a flared member extending from the end wall, a squeeze handle portion extending perpendicular to the body and spaced apart from the first end wall, a central opening within the body and surrounded by an end wall, a pair of parallel sidewalls and another end wall having a first tooth extending into the opening, the oppositely extending wall extending to a second end opening surrounded by the extending wall, a pair of sidewalls, and a pair of oppositely extending flair members also forming an end wall of the second end opening.
Figure 7E:
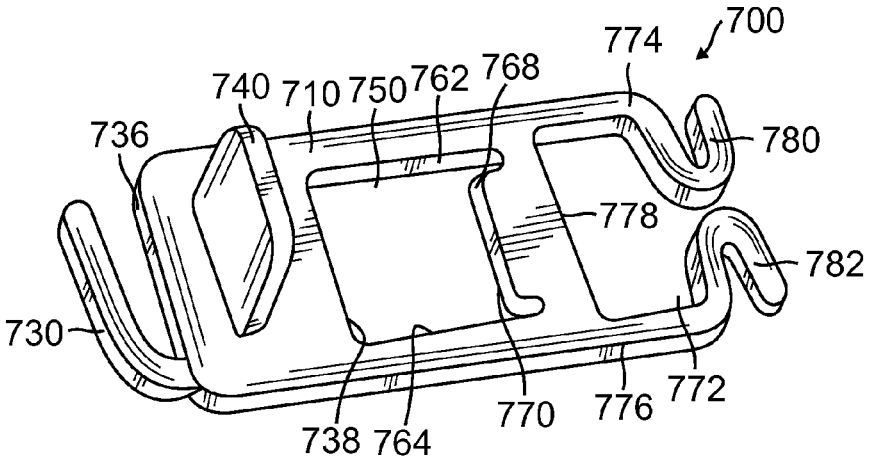
FIG. 7E is a top perspective view of a second section of a second retention mechanism 800 including a body having a pair of flared oppositely extending members at one end and forming an end wall of a first end opening within the body, the first end opening surrounded by a pair of oppositely disposed sidewalls and an end wall, a horizontal tooth formed in the body facing a central opening which is surrounded by a tooth retaining wall at one end and a pair of sidewalls and an end wall of the body, and a squeeze handle portion extending perpendicular to the body and adjacent an opposite end of the body and a flared member extending from the opposite end wall of the body.
Figure 7F:
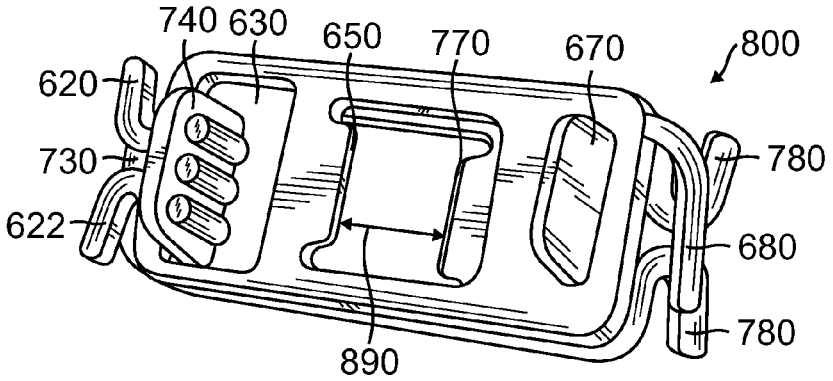
FIG. 7F is a top perspective view of the assembled second retention mechanism with the first section on top of the second section so that first squeeze handle portion of the first section extends sitting on top of the first end opening of the second section and the first squeeze handle portion of the second section extends through the second end opening of the first section, the middle openings are aligned so that the tooth from the first section and the tooth from the second section face into the aligned middle openings and towards each other with a gap between the teeth, the tooth from the first section at a location elevated higher than the location of the tooth of the second section, the pair of flared oppositely extending members of the first section resting on and above the flared member of the second section and the flared member of the first section resting on and above the pair of flared oppositely extending members of the second section.
Figures 1, 8A:
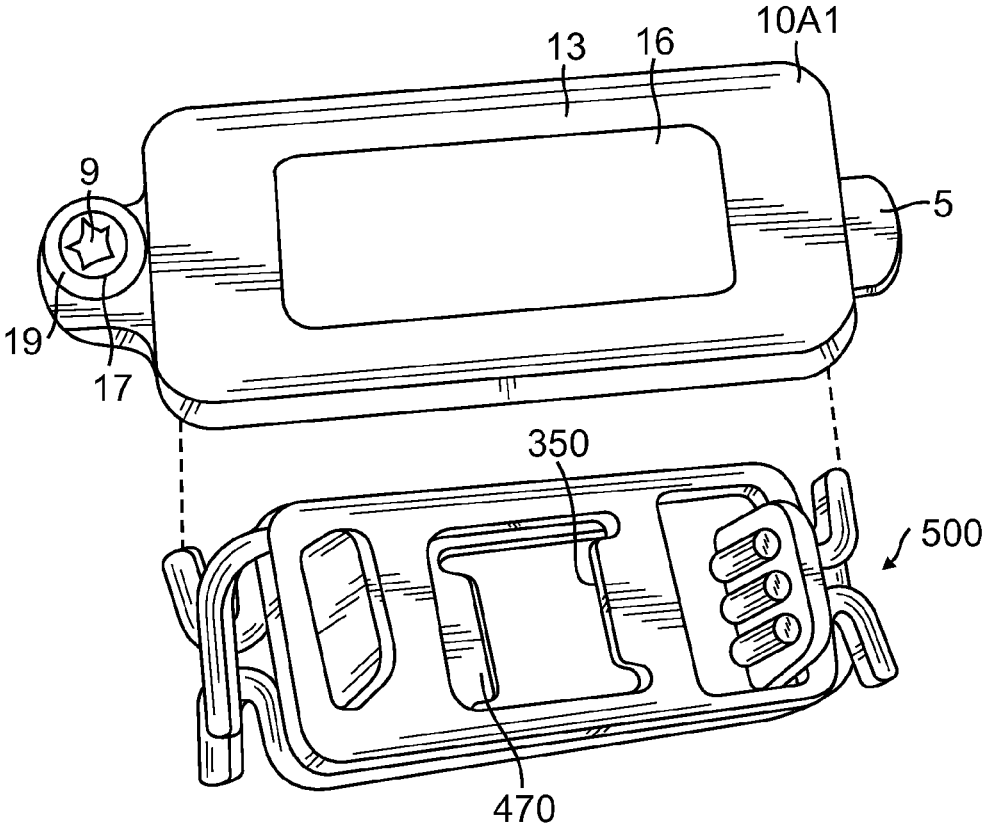
Figures 2, 8A:
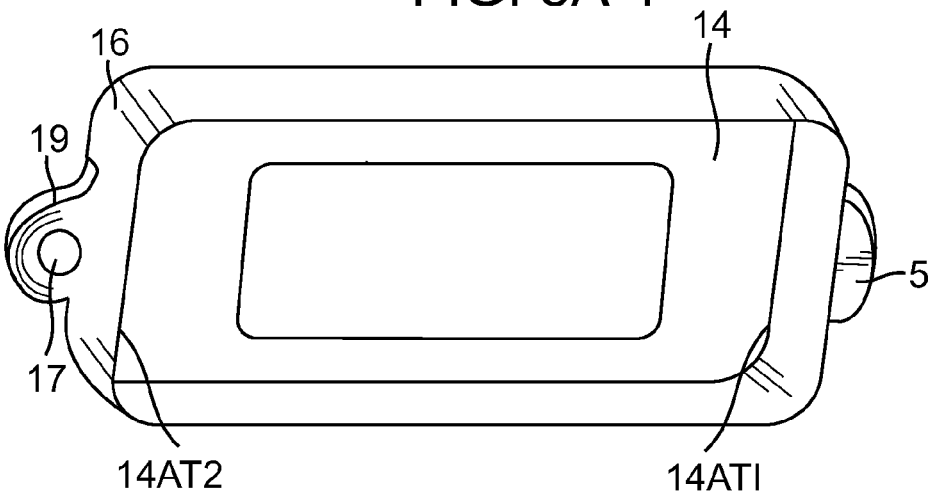

With respect to the squeeze operating mechanism, the squeeze operating mechanism fits into a collar 10 as shown beginning in FIG. 8A-1. In the preferred embodiment, the two teeth 350 and 470 from the squeeze operating mechanism 500 are offset at different heights since the first section 300 is above the second section 400. For the squeeze operating mechanism illustrated in FIGS. 7A through 7C, the tooth 350 on the outside is higher than the tooth 450 on the inside. For the mechanism shown in FIGS. 7D-7F, the tooth on the outside is higher than the tooth on the inside.

In the preferred embodiment of the present invention, the tooth extending into the notch of the post on the inside will be lower than the tooth extending into the notch on the outside. Therefore, the squeeze mechanism illustrated in FIGS. 7A-7C is inserted into the housing 10 and the squeeze mechanism shown in FIGS. 7D-7F is inserted into the housing 10A. The collar 10A1 has an exterior rim 13 with an interior circumferential rim 14 with interior transverse walls 14AT1 and 14AT2 and a central opening 16 into which the squeeze mechanism 500 is inserted. Because the outer tooth 350 is higher than the inner tooth, this mechanism goes into the right assembly collar 10. The way the mechanism is inserted is that the assembly is inserted onto the top surface 18 of well 130 and the post 260 from sponge 200 is inserted through opening 6 in recessed surface 8 of the bottom surface 108, the post 260 extends above surface 18 of well 130 and to the area of gap 490. The outer tooth 771 is inserted into an exterior notch on post 260 and then the collar 10 is screwed down through fastening mechanism 9 such as a screw which extends through opening 17 of an extension 19 of collar 10 which is screwed into the top surface 18 of the interior well 130. As this is achieved, the second tooth 470 is inserted into the interior notch in post 260.

FIG. 7D is a top perspective view of a first section 600 of a second retention mechanism including a body 610 having a first end wall 676 and a flared member 680 extending from the end wall 676, a first squeeze handle portion 670 extending perpendicular to the body 610 and spaced apart from the first end wall 676, a central opening 660 within the body 610 and surrounded by an end wall 668, a pair of parallel sidewalls 662 and 664 and another end wall 652 having a first tooth 650 extending into the opening 660, the oppositely extending wall 634 extending to a second end opening 630 surrounded by the extending wall 634 a pair of sidewalls 632 and 634, and a pair of oppositely extending flair members 620 and 622 also forming an end wall of the second end opening 630.

FIG. 7E is a top perspective view of a second section 700 of a second retention mechanism 800 including a body 710 having a pair of flared oppositely extending members 780 and 782 at one end and forming an end wall of a first end opening 772 within the body 710, the first end opening 772 surrounded by a pair of oppositely disposed sidewalls 774 and 776 and an end wall 778 of the body 710, a horizontal tooth 770 formed in the body wall 768 facing a central opening 770 which is surrounded by a tooth retaining wall 768 at one end and a pair of sidewalls 762 and 764 and an end wall 738 of the body 710, and a squeeze handle portion 740 extending perpendicular to the body 710 and adjacent an opposite end 736 of the body and a flared member 730 extending from the opposite end wall 736 of the body 710.

FIG. 7F is a top perspective view of the assembled second retention mechanism with the first section 600 on top of the second section 700 so that first squeeze handle portion 740 of the second section 700 extends through second end opening of the first section 600 and the first second squeeze handle portion 670 of the first section sits on first opening 772 of second section 700, the middle openings 660 and 750 are aligned so that the tooth 650 from the first section 600 and the tooth 770 from the second section 700 face into the aligned middle openings 660 and 750 and towards each other with a gap 890 between the tooth 650 and the tooth 770, the tooth 650 from the first section 600 at a location elevated higher than the location of the tooth 770 of the second section 700, the pair of flared oppositely extending members 620 and 622 of the first section 600 resting on and above the flared member 730 of the second section 700 and the flared member 680 of the first section 600 resting on and above the pair of flared oppositely extending members 780 and 782 of the second section 700.

Figures 1, 8B:
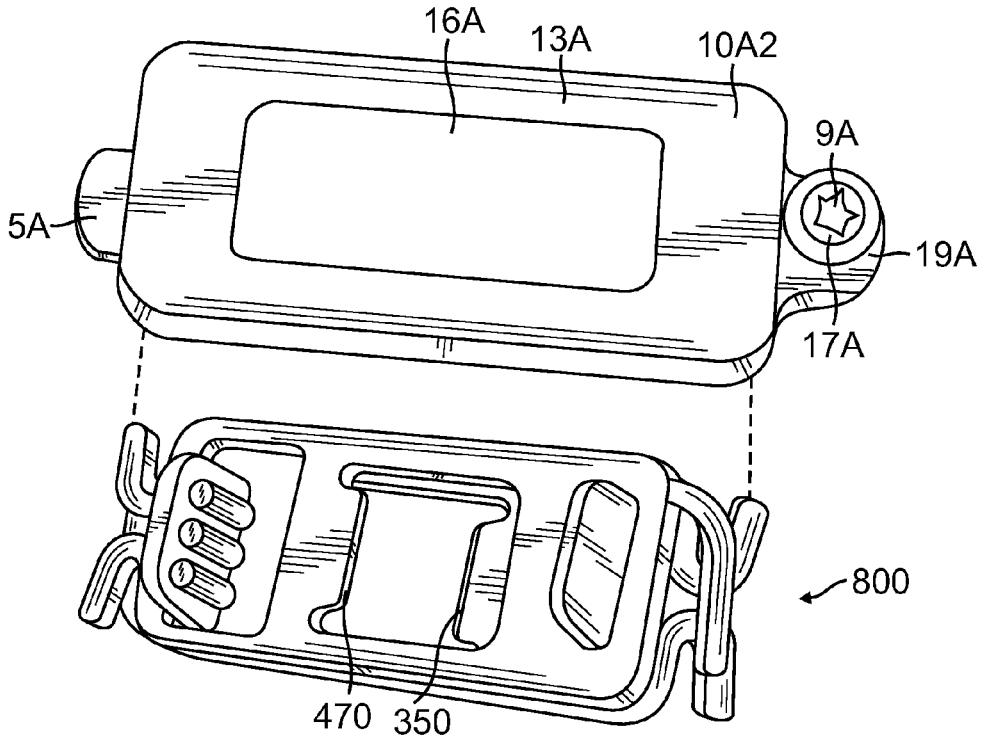
Figures 2, 8B:
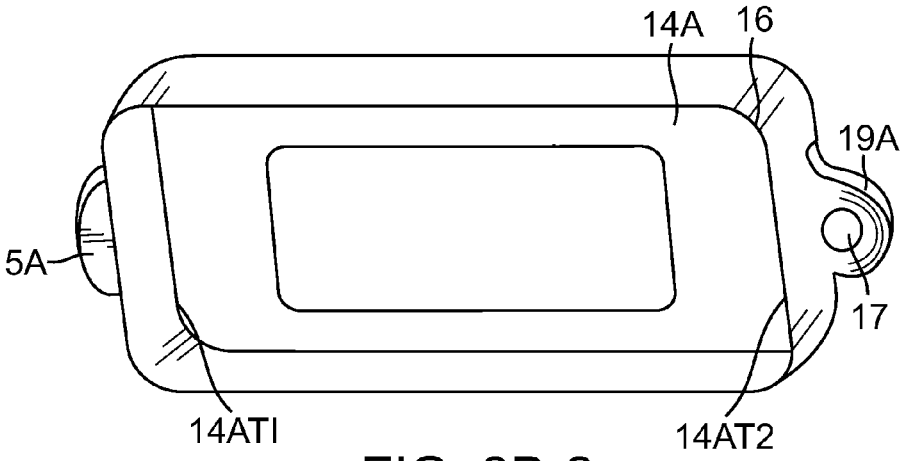

Similarly, referring to FIGS. 8B-1 and 8B-2, the same process occurs for the left squeezing mechanism into collars 10A2. The assembly including collar 10A2 with an exterior rim 12A and a interior circumferential rim 14A with transverse sides 14AT1 and 14AT2, and second retention mechanism 800 are placed onto the top surface 18A and well 130A. The post 260A from sponge 200 is inserted through opening 6A in recessed surface 8A of bottom surface 108, the post 260A extends above surface 18A of well 130A and to area of gap 890, and exterior tooth 650 is inserted into an external notch of post 260A and then the housing 10A is screwed down by fastening mechanism 9A (a screw), interior lower tooth 650 is inserted into the exterior notch in post 260A and then collar 10A screwed down by screw 9 which extends through opening 17A in extension 19A, and then the lower tooth on the inside 770 is inserted into a lower notch in post 260A. The mop mechanism as shown in FIGS. 4A and 4B is inserted as shown in FIG. 6 so that post 260 is placed into gap 490 and post 260A is placed into gap 890 so that it is inserted through the bottom of the channel of the receiving member as illustrated in FIG. 3 and then the two squeeze members 440 and 370 are squeezed together to permit post 260 to be inserted between them and squeeze members 670 and 740 are squeezed together to permit post 260A to be inserted between them. Therefore, the posts are grasped. As illustrated in the cross-sectional view of FIG. 9, the retention mechanism is such that the tooth on the outside is higher than the tooth on the inside.

FIG. 8A-1 is a an exploded top perspective view of the first retention mechanism housing and the first retention member before it is inserted into the first retention mechanism housing.

FIG. 8A-2 is a bottom perspective view of the first retention mechanism housing.

FIG. 8B-1 is an exploded top perspective view of the second retention mechanism housing and the second retention member before it is inserted into the first retention mechanism housing.

FIG. 8B-2 is a bottom perspective view of the second retention mechanism housing.

FIG. 9 is a cross-sectional view taken along line 9-9 of FIG. 6 to illustrate the operations of the present invention. The sponge 200 with plate 230 retained onto the top 220 of sponge 200 has a pair of spaced apart posts 260 and 260A molded onto the top 250 of plate 230. Each post has transverse notches as previously described. Post 260 is inserted into opening 6 and extends into the gap 490 and first retention member 500 within collar 10. Post 260A is inserted into opening 6A and extends into the gap 890 of second retention member 800. Tooth 350 is inserted into notch 260N1 while squeeze handle 440 extends above the assembly and tooth 650 is inserted into notch 260N6 while squeeze handle 370 extends above the assembly. Flared members 320, 322 and 430 are compressed against interior transverse wall 14T1 of housing 10 and flared members 380, 480 and 482 and compressed against interior transverse wall 14T2 of housing 10. The flared members function as springs to return the respective teeth 350 and 650 into engagement with a notch in post 260.

Similarly, post 260A is inserted into opening 6A and extends into the gap 890 and second retention member 800. Tooth 650 is inserted into notch 260AN1 while squeeze handle 740 extends above the assembly and tooth 770 is inserted into notch AN7. Flared members 620, 622 and 730 are compressed against interior transverse wall 14AT1 of housing 10A and flared members 680, 780 and 782 are compressed against interior transverse wall 14AT2 of housing 10A. The flared members function as springs to return the respective teeth 650 and 770 into engagement with a notch in post 260A.

In operation, when the sponge 200 is dirty, squeeze handles 370 and 440 are squeezed together so that the retention force of flared spring members 380, 480 and 482, and on the other side 320, 322 and 430, are overcome and tooth 350 and tooth 470 are pushed/rotated away from their respective notches in post 260. Similarly squeeze handles 740 and 670 are squeezed together so that the retention force of flared spring members 620, 622 and 730, and on the other side 680, 780 and 782 are overcome and tooth 650 and tooth 770 are pushed/rotated away from their respective notches in post 260A. As a result, the sponge 200 is released and falls into a trash receptacle without a person's hand touching a dirty sponge.

For a new sponge 200, the sponge is inserted as described above with the posts 260 and 260A extending into the gaps 490 and 890. While the squeeze hands are compressed together. After the posts re inserted, the squeeze handles are released and the flared members spring forces cause a respective tooth to engage a respective notch in a post as previously descried to retain the new sponge in the retention members.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. An apparatus used in conjunction with a hand operated sponge mop, comprising:

a. a sponge assembly including a pair of spaced apart posts molded onto an upper surface of a plate, the plate also having a lower surface affixed onto an upper surface of a sponge of the sponge mop, each post having a multiplicity of ascending transverse notches on opposite sidewalls of each post, the ascending transverse notches extending vertically away from the upper surface of the plate;

b. a main body having a top surface with a pair of spaced apart housings, the housings including a first housing aligned with a first end of the main plate, the first housing having a central opening extending through a top surface to the bottom surface of the first housing and a second housing adjacent a second spaced apart second end of the main body, the second housing having a central opening extending from its upper surface to its lower surface, each respective first housing and second housing having a body including a retention member to retain a respective first housing and second housing to the top surface of the main body, each housing having a housing opening, the main body having a pair of openings extending from the top surface of the main body to a bottom surface of the main body, each respective opening respectively positioned so that a respective opening at the top surface of the main body is aligned within a respective first housing and a second housing with a respective opening in the first housing aligned with a respective opening in the main body and a respective opening in the second housing aligned with a respective opening in the main body;

c. a respective post inserted through a respective opening in the main body so that a respective post extends into and within a respective housing and the sponge is adjacent the bottom surface of the main body; and d. the main body having a pair of spaced apart operating mechanisms retained within a respective housing, each respective operating mechanism including spaced apart post retention members on opposite sides of a post, each retention member including a respective tooth respectively adjacent to opposite vertical sides of a post extending into a respective housing, a respective tooth respectively received in a respective transverse notch of a post, each tooth formed as part of a tooth section having a transverse first tooth and a spaced apart transverses second tooth, an upper squeeze handle which extends into the respective housing opening, each tooth section further including a respective exterior flared section with a pair of oppositely disposed flared sections retained within a respective housing body and respectively pressed against opposite transverse walls of a housing body to enable each respective pair of flared sections to function as a spring with a spring force of a respective pair of flared sections forcing a respective tooth into engagement with a transverse notch on a post to thereby retain the sponge against the bottom surface of the main body, and a squeeze force applied by squeezing two oppositely disposed squeeze handle sections together overcomes the spring force and disengages a respective tooth from a respective notch in a post, thereby releasing the sponge.

2. The apparatus used in conjunction with a hand operated sponge mop in accordance with claim 1, further comprising:

a. the plate is made of moldable material; and b. the plate is molded on its lower surface to the upper surface of the sponge.

3. The apparatus used on conjunction with a hand operated sponge mop in accordance with claim 1, further comprising:

a. the main body has at least a first transverse side and a second oppositely disposed transverse side;

b. the pair of spaced apart posts includes a first post having a first transverse side with a first multiplicity of ascending notches facing a direction toward the first transverse side of the main body and an opposite second transverse side with a second multiplicity of ascending notches facing a direction toward the second transverse side;

c. the pair of spaced apart posts includes a second post having a first transverse side with a first multiplicity of ascending notches facing a direction toward the first transverse side of the main body and an opposite second transverse side with a second multiplicity of ascending notches facing a direction toward the second transverse side; and d. the first post is closer to the first transverse side than the second transverse side and the second post is closer to the second transverse side than the first transverse side.

4. The apparatus used in conjunction with a hand operated sponge mop in accordance with claim 3, further comprising:

a. the pair of spaced apart operating mechanisms includes a first operating mechanism and a second operating mechanism;

b. the first operating mechanism is retained in the first housing, the first operating mechanism includes a first pair of tooth retaining members including a horizontal tooth section and a vertical squeeze member section, the first pair of tooth sections facing each other with a gap between the horizontal tooth sections into which the first post from the upper sponge is inserted and retained on opposite transverse sides of the first post by a respective tooth of the first tooth and the second tooth respectively inserted into a respective notch on opposite sides of the first post; and c. the second operating mechanism is retained in the second housing, the second operating mechanism includes a second pair of tooth retaining members including a horizontal tooth section and vertical squeeze member section, the second pair of tooth sections facing each other with a gap between the horizontal tooth sections into which the second post from the upper surface of the sponge is inserted and retained on opposite transverse sides of the second post by a respective tooth of the second pair of first tooth and second tooth inserted into a respective notch on opposite sides of the second post.

5. The apparatus used in conjunction with a hand operated sponge mop in accordance with claim 4, further comprising:

a. the first operating mechanism includes a first body having a pair of oppositely disposed extending flared members at one end and forming an end wall of a first end opening within the body, the first end opening surrounded by a pair of oppositely disposed sidewalls and an end wall which extends to a horizontal tooth formed in the body facing a central opening which is surrounded by a tooth retaining wall at one end and a pair of sidewalls and an end wall of the body, and a second squeeze handle portion extending perpendicular to the body and adjacent an opposite end of the body and a flared member extending from the opposite end wall of the body;

b. the first operating mechanism includes a second body having a first end wall and a flared member extending from the first end wall and aligned with a first end opening in the main body, a first squeeze handle portion extending perpendicular to the body and spaced apart from the first end wall, a central opening within the body and surrounded by an end wall, a pair of parallel sidewalls and another end wall having a second tooth extending into the opening, the oppositely extending wall retaining the tooth extending to the opening, the oppositely extending wall retaining the tooth extending to a second end opening surrounded by the extending wall, a pair of sidewalls, and a pair of oppositely extending flair members also forming an end wall of the second end opening; and c. the first operating mechanism is assembled with the first body on top of the second body so that second squeeze handle portion of the first body extends sitting on top of the first end opening of the second body and the first squeeze handle portion of the second body extends through the first end opening of the first body, each central opening of the first and second body are aligned so that the tooth from the first body and the tooth from the second body face into the aligned central opening and towards each other with a gap between each, the tooth from the first body is at a location elevated higher than the location of the tooth of the second body, the pair of flared oppositely extending members of the first body resting on and above the flared member of the second body and the flared member of the first body resting on and above the pair of flared oppositely extending members of the second body.

6. The apparatus used in conjunction with a hand operated sponge mop in accordance with claim 5, further comprising:

a. the first operating mechanism fits into the first housing with the tooth in the first body and the tooth in the second body offset at different heights since the first body is above the second body; and b. the tooth on the first body is closer to the first transverse side of the main body and is inserted into a notch of the first post sidewall higher than the notch of the opposite first post sidewall into which the tooth from the second body is inserted.

7. The apparatus used in conjunction with a hand operated sponge mop in accordance with claim 6, further comprising:

a. the first operating mechanism is retained into the first housing which has a collar having an exterior rim with an interior circumferential rim at one end and a tab at an opposite end, with interior transverse sides and a central opening into which the first operating mechanism is inserted; and b. the way the first operating mechanism is inserted is that the first operating mechanism is placed onto the top surface of the main body and the first post from the sponge is inserted through an opening in the main body and extends above the top surface of the main body and to the area of the gap with each tooth from the first operating mechanism inserted into a respective notch of the first post, the top surface has a first slit and the tab of the first housing is inserted into the first slit and then the collar on an opposite side from the tab is screwed down through a fastening mechanism into the top surface of the main body.

8. The apparatus used in conjunction with a hand operated sponge mop in accordance with claim 4, further comprising:

a. the second operating mechanism includes a first body having a first end wall and a flared member extending from the first end wall, a second squeeze handle portion extending perpendicular to the body and spaced apart from a second end wall, a central opening within the first body and surrounded by an end wall, a pair of parallel sidewalls and another end wall having a first tooth extending into the central opening, the oppositely extending wall extending to a second end opening surrounded by the extending wall, a pair of sidewalls, and a pair of oppositely extending flair members also forming an end wall of the second end opening;

b. the second operating mechanism include a second body having a pair of flared oppositely extending members at one end and forming an end wall of a first end opening within the body, the first end opening surrounded by a pair of oppositely disposed sidewalls and an end wall of the body, a horizontal tooth formed in the body wall facing a central opening which is surrounded by a tooth retaining wall at one end and a pair of sidewalls and an end wall of the body, and a first squeeze handle portion extending perpendicular to the body and adjacent an opposite end of the body and a flared member extending from the opposite end wall of the body; and c. the second operating mechanism is assembled with the first body on top of the second body so that first squeeze handle portion of the second body extends through second end opening of the first body and the second squeeze handle portion of the first section sits on top of first opening of the second body, the central openings are aligned so that the tooth from the first body and the tooth from the second body face into the aligned central openings and towards each other with a gap between each tooth, the tooth from the first body at a location elevated higher than the location of the tooth of the second body, the pair of flared oppositely extending members of the first body resting on and above the flared member of the second body and the flared member of the first body resting on and above the pair of flared oppositely extending members of the second body.

9. The apparatus used in conjunction with a sponge mop in accordance with claim 8, further comprising:

a. the second operating mechanism fits into the second housing with the tooth in the first body and the tooth in the second body offset at different heights since the first body is above the second body; and b. the tooth on the first body is closer to the second transverse side of the main body and is inserted into a notch of the second post sidewall higher than the notch of the opposite second post sidewall into which the tooth from the second body is inserted.

10. The apparatus used in conjunction with a sponge mop in accordance with claim 9, further comprising:

a. the second operating mechanism is retained into the second housing which has a collar having an exterior rim with an interior circumferential rim at one end and a tab at an opposite end, with interior transverse sides and a central opening into which the second operating mechanism is inserted; and b. the way the second operating mechanism is inserted is that the second operating mechanism is positioned onto the top surface of the main body and the second post from the sponge is inserted through an opening in the main body and extends above the top surface of the main body and into the area of the gap with each tooth from the second operating mechanism inserted into a respective notch of the second post, the top surface has a second slit and the tab of the second housing is inserted into the second slit and then the collar on an opposite side from the tab is screwed down through a fastening mechanism into the top surface of the main body.

11. The apparatus used in conjunction with a hand operated sponge mop in accordance with claim 1, further comprising:

a. the sponge mop is a squeeze sponge mop with a handle retaining member affixed to the main body; and b. a squeeze member rotatably affixed to the main body to wring water out of the sponge.

12. The apparatus used in conjunction with a hand operated sponge mop in accordance with claim 11, further comprising: a scrub brush affixed to the main body.

* * * * *